US005330186A

United States Patent [19]

Jones

[11] Patent Number: 5,330,186

[45] Date of Patent: Jul. 19, 1994

[54] PUZZLE BOX

[76] Inventor: Timothy M. Jones, Rte. 10, Box 314, Greeville, Tenn. 37743

[21] Appl. No.: 941,243

[22] Filed: Sep. 4, 1992

[51] Int. Cl.[5] ..... A63F 9/08

[52] U.S. Cl. ..... 273/153 S; 273/160; 70/289

[58] Field of Search ..... 273/153 S, 153 R, 160, 273/156; 206/1.5; 70/289, 287, 288

[56] References Cited

U.S. PATENT DOCUMENTS

| | | | |
|---|---|---|---|
| 822,032 | 5/1906 | Westby | 206/1.5 |
| 988,191 | 3/1911 | Heidtmann | 206/1.5 |
| 3,216,558 | 11/1965 | Marsh | 206/1.5 |
| 4,206,923 | 6/1980 | Cloutier | 273/160 |
| 4,283,055 | 8/1981 | Larsen | 273/160 |
| 4,397,466 | 8/1983 | Nichols | 273/156 |
| 4,782,676 | 11/1988 | Friedman | 70/289 |
| 4,811,948 | 3/1989 | Gutierrez | 273/156 |
| 4,880,238 | 11/1989 | Derovin | 273/160 |
| 5,035,430 | 7/1991 | Suzuki | 273/153 |
| 5,125,661 | 6/1992 | Jarboe | 273/156 |

FOREIGN PATENT DOCUMENTS

| | | |
|---|---|---|
| 1440519 | 11/1988 | U.S.S.R. . |
| 1533715 | 1/1990 | U.S.S.R. . |

*Primary Examiner*—Vincent Millin
*Assistant Examiner*—Steven B. Wong
*Attorney, Agent, or Firm*—Edward M. Livingston

[57] ABSTRACT

A puzzle box device (1) having a top lid (2) and a bottom (4) with sides (21) attached thereto, the sides connected by fixed corner pieces (5). The sides (21) contain a plurality of sliding panels (8), some with locking pins (10, 12) and some being spring-mounted panels (16). Depressing and sliding these various panels in the proper sequence enables the top lid (2) to be unlocked and removed. The sides (21) of the puzzle box device may have inner surface (22) and outer surface (23) leaving a hollow inner-cavity (11) for the placement of valuables or gifts if desired.

5 Claims, 2 Drawing Sheets

PUZZLE BOX

BACKGROUND OF THE INVENTION

This invention relates to puzzle games, and more particularly, to an improved puzzle box with removable and unlockable top lid.

Normally, puzzle boxes are block-shaped boxes made of wood having sliding panels on the outside which when moved in the proper direction and sequence enable the top lid of the puzzle box to be unlocked and removed. Puzzle boxes and other puzzle block games have existed for a long time, having first been invented by the Chinese more than 1,000 years ago. Such prior puzzle boxes used merely sliding panels that would often slide beyond the corners of the box and thus could be lost.

The prior patented art relating to puzzle box device includes U.S. Pat. No. 3,216,558 by Marsh, dated Nov. 9, 1965, which teaches a puzzle box as interlocking removable panels which use latch, latches and catches to lock the panels. However, the Marsh patent utilizes no spring-loaded panels and does not use locking pins as does the present invention.

Soviet Patent No. 1,533,715 by Svinarenko, dated Jan. 7, 1990, shows a three-dimensional puzzle box game that has cubes which can be rotated, but bears no resemblance to the present invention.

U.S. Pat. No. 4,397,466 by Nichols, dated Aug. 9, 1983, teaches a puzzle formed in multiple stacked disks that can be rotated into differens patterns by depressing pegs.

U.S. Pat. No. 5,035,430 by Suzuki, dated Jul. 30, 1991, teaches a spherical puzzle toy having projections that must be depressed in a certain pattern to unlock an internal mechanism.

U.S. Pat. No. 4,206,923 by Cloutier, dated Jun. 10, 1980, teaches a dice block puzzle with through holes with which in which notched rods must be inserted in a certain pattern for proper assembly.

U.S. Pat. No. 4,811,948 by Gutiérrez, dated Mar. 14, 1989, shows another block puzzle with pegs similar to the Cloutier patent.

Soviet Pat. No. 1,440,519, dated Nov. 30, 1988, teaches a puzzle box with moveable tiles that can be moved from one cell to another and does utilize springs. However, it too has a different structure than the present invention.

Unlike the prior art, the puzzle box of the present invention has fixed-corner pieces on the sides which prevent the side panels from sliding beyond the corners of the sides and becoming lost. In addition, the present invention has sliding panels which are spring mounted and can be depressed to allow other panels to slide over them. Furthermore, locking pins extend from some of the side and top panels to make the puzzle more challenging and difficult to solve.

The latter novel features in the present invention provide numberous advantages and aobjectives not avilable hereto.

SUMMARY OF THE INVENTION

The primary object of the present invention is to provide a puzzle box device which is amusing and entertaining.

Another object of the present invention is to provide a puzzle box device with interlocking pieces which cannot be removed or lost inadvertently during use.

A further object of the present invention is to provide an improved puzzle box device which is more challenging than such prior devices.

Yet another object of the present invention is to provide a novelty item which is suitable as a gift, conversation piece, or art object.

The present invention accomplishes the above and other objects by providing an improved puzzle box having top lid, a bottom and sides connected fixedly to the bottom, the sides having sliding panels and depressible spring-mounted panels over which the sliding panels can slide when in a depressed position. The sides are connected by fixed corner pieces at their intersection, which prevent the inadvertent removal and possible loss of the sliding panels. The sides of the box may have outer and inner walls such that the box contains a hollow cavity inside to hold desired items. Some of the sliding panels may have locking pins which fit into matching holes in adjoining panels or corner pieces to further secure the puzzle box and make it more challenging to solve. The top lid of the puzzle box may also contain spring-mounted and/or sliding panels with or without locking pins, to further secure the lid in place. When the spring-mounted panels and sliding panels on the sides are depressed and/or moved, respectively, in a certain sequence, the top lid may be unlocked and removed. If the top lid also contains spring mounted and slidable panels, then those panels must also be depressed or slid in the proper sequence to remove the top lid. To relock the puzzle box, the reverse sequence of steps would be required.

Other objects and feature of the present invention may become even more readily apparent when a detailed embodiment of the invention is described in conjunction with the drawing figures contained herein.

BRIEF DESCRIPTION OF THE DRAWINGS

This drawing figures used to illustrate the preferred embodiments of the present invention are as follows.

DESCRIPTION OF THE PREFERRED EMBODIMENTS

Figure 1:
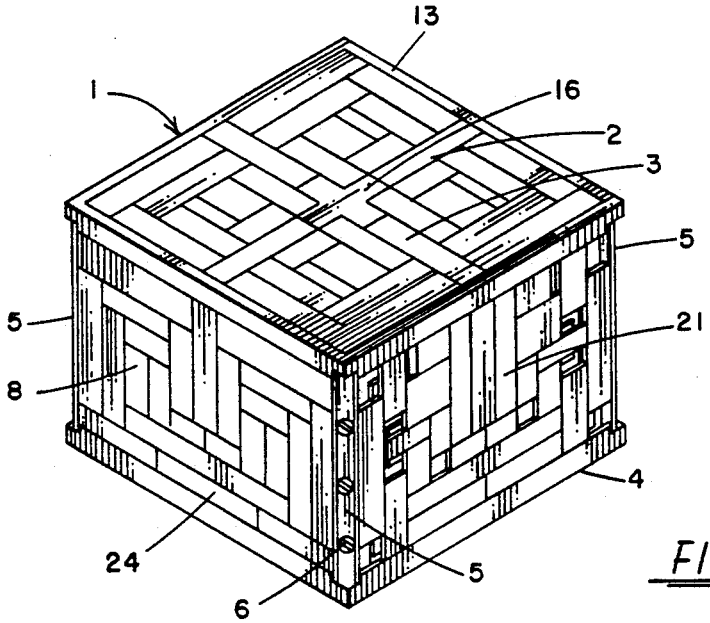
FIG. 1 is a perspective view of the puzzle box in a closed, unsolved position.

Referring now to the drawings, the puzzle box, generally 1, is shown with a top lid 2, four sides 21 and a bottom 4. The sides 21 are rigidly fixed to the bottom 4 and connected by fixed corner pieces 5, secured by screws 6 at the intersection of the sides 21. The sides 21 have various sliding panels 8 which cannot slide beyond the fixed corner pieces 5. The top lid 2 may also have sliding panels 3 which cannot be moved without first depressing the spring-mounted piece 16 in the top lid 2.

Figure 2:
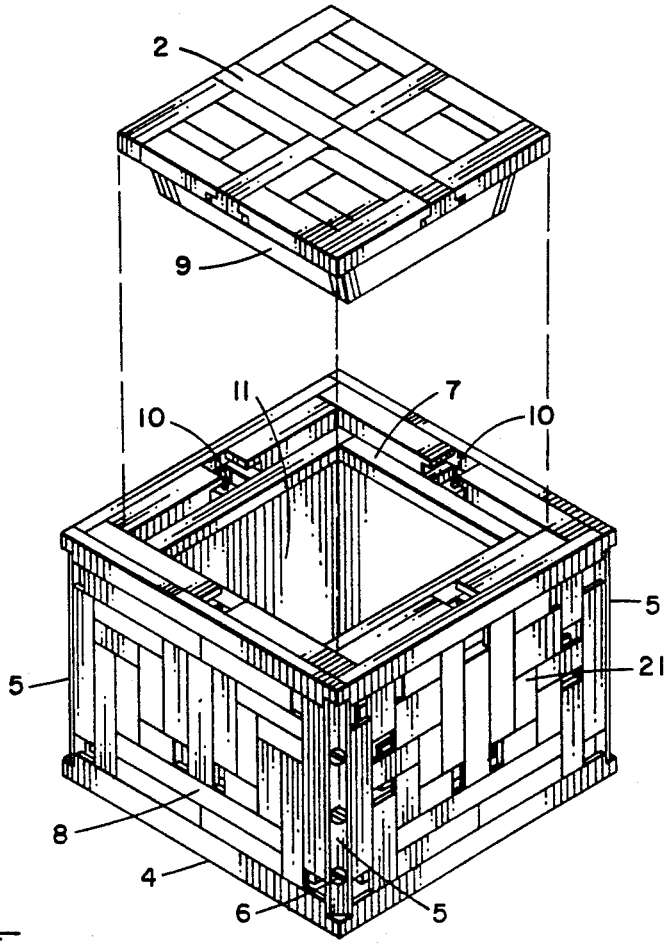
FIG. 2 is perspective view of the puzzle box in the open, solved position with top lid removed.

The open, solved puzzle box with the top lid removed is illustrated in FIG. 2 and shows various other features of the puzzle box not shown in FIG. 1. For instance, the puzzle box may have a hollow interior cavity 11 for storing valuables or gifts. The sides 21 of the puzzle box may also have panels 8 which slide in a vertical plane with locking pins 10 which fit into notches or holes in the top lid 2 to further secure the top lid 2 to the puzzle box 1. The top lid 2 of the puzzle box may also have a tapered base 9 to fit snugly within the puzzle box.

Figure 3:
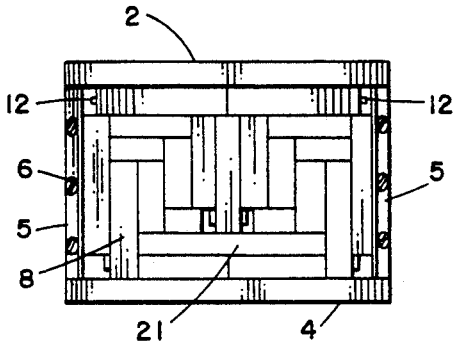
FIG. 3 is a side view of the puzzle box.

FIG. 3 which depicts one side 21 of the puzzle box shows the top locking pins 10 and also some locking pins 12 in various sliding panels 8 of the puzzle box. As the puzzle box has fixed corner pieces 5, some of the movable panels on the sides 21 must be spring-mounted, such as 24 shown in FIG. 1, in order to enable the sliding panels 8 to move. The manner in which movable panels, such as 24, are spring mounted is described and illustrated below in relation to FIG. 5.

Figure 4:
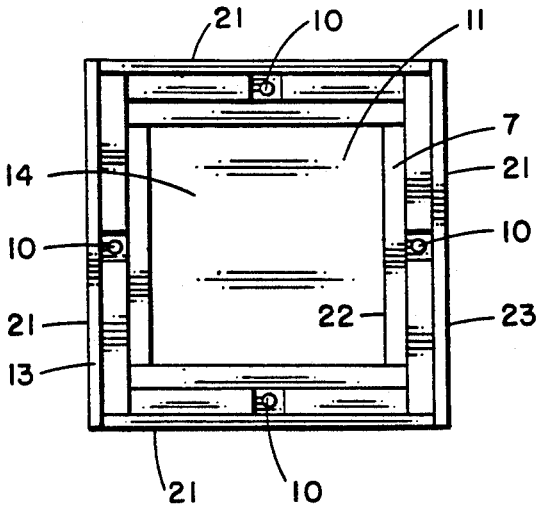
FIG. 4 is a top view of the puzzle box without the top lid.

FIG. 4 shows the interior bottom 14 of the puzzle box which is surrounded by four vertical sides 21, each side having an inner wall 22 and outer wall 23 to form a cavity 11 inside the puzzle box. In this particular embodiment, between the inner and outer walls 22 and 23, respectively, are located locking pins 10

Figure 7:
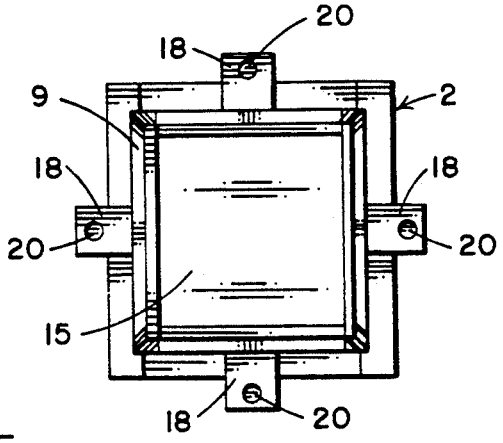
FIG. 7 is a top view of the bottom of the top lid to the puzzle box.

Such locking pins consist preferably of metal spindles imbedded in the ends of the slidable panels. In this particular case, as illustrated in FIGS. 4 and 2, locking pins 10 are connected to vertically-sliding side panels 8 so that when the panels are slid vertically-upward the pins fit into holes 20 on the bottom of the top lid 2, as shown further in FIG. 7, to secure the top lid 2 to the puzzle box. Vice versa when the panels with pins 10 are slid vertically-downward the pins 10 are detracted from the holes 20 in panels 18, as shown in FIG. 7, to allow panels 18 to be moveable.

Figure 5:
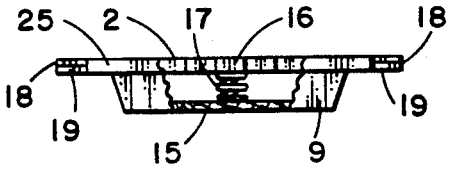
FIG. 5 is side partial cut-away view of the top lid.

FIG. 5, which shows the top lid 2 by itself, shows that the top lid 2 as being comprised of top panel 25 and tapered base 9, with a bottom 15 which fits over the opening of the puzzle box 1. A spring-mounted panel 16 is mounted on a coil spring 17 for urging the panel into the plane of the sliding panels 18. Then, when the vertically-sliding, locking panels 8 are moved downward so that the locking pins 10 no longer are engaged or lodged into holes 20 on top sliding panels 18, then top sliding panels 18 may be pushed inward over panel 16 after depressing it to allow the top lid 2 to be removed from the puzzle box 1.

A cavity under or behind each spring-mounted panel enables such a panel to be depressed so that other panels can be slid over the top of said spring-mounted panels. To make a spring-mounted panel, like 16 or other selected panels, two small circular grooves sufficient to retain the top and bottom of a coil spring 17 are made in the bottom of the panel 16 and in the top of the base panel, such as the top lid 15. Once the spring is inserted, the panel is retained in place from springing outward away from the box by the tongue and groove fit of the spring-mounted panels with the adjoining panels.

Figure 6:
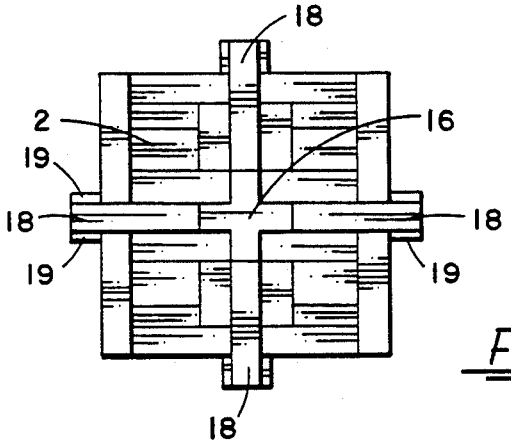
FIG. 6 is a top view of the top lid.

Another view of the top lid 2 in FIG. 6 shows the spring-mounted panel and the sliding panels 18 when the spring-mounted panel 16 is the upright position. Each sliding panels 18 has grooves 19 to facilitate easy sliding in and out from the top lid 2.

The final illustration in FIG. 7 shows the bottom 15 of the top lid 2 having a tapered base 9, sliding panels 18 and locking pin holes 20.

Although only a cubic version of the puzzle box has been illustrated in the drawing figures, the puzzle box can have almost any shape, even spherical or pyramidal, and still have the features of depressible and sliding panels, locking pins and fixed end panels to prevent sliding panels from inadvertently being removed and possibly becoming lost.

The sequence of panel movement for opening the puzzle box can vary from box to box depending on the construction and location of the panels as determined and desired by the maker. Generally, however, the opening sequence must start with depressing a spring-mounted panel on one side of the puzzle box, which makes space for adjoining panels to slide over the depressed spring-mounted panels, which in turn makes more space to move other panels. Various numbers of panels may be moved until the vertical panels containing the locking pins can be slid downward to release the sliding panels in the top lid. Similarly, the top lid is removed by following the same basic sequence starting with depressing a spring-mounted panel or panels and sliding others until the top lid is released. Reversing the particular sequence locks the box and returns it to its original condition.

The puzzle box may be made of almost any rigid material, such as wood or plastic.

As described hereinabove, a new and improved puzzle box device has been set forth which contains in combination features not existing in the prior art, including, but not limited to, spring-mounted depressible panels, sliding panels, both with or without locking pins, and fixed panels to prevent the inadvertent removal and loss of sliding panels.

Although only one preferred embodiment of the present invention has been described in detail hereinabove, all improvements and modifications to this invention within the scope or equivalents of the claims are covered by this invention.

I claim:

1. An improved puzzle box device having a top lid, bottom and sides connected fixedly to the bottom, said sides having a plurality of sliding panels defining a plane and at least one depressible panel mounted on a spring urging said at least one depressible panel into said plane over which selected sliding panels can be moved when said depressible panels are depressed, said sides having fixed corners at the intersections thereof, and wherein movement of the sliding panels on the sides of the box in a desired predetermined sequence permits unlocking and removal of the top lid.

2. The puzzle box device of claim 1 wherein each side has an outer and inner wall to form a hollow cavity inside the puzzle box to hold desired items.

3. The puzzle box device of claim 1 or 2 wherein selected sliding panels on the sides of the puzzle box have locking pins which fit into notches in adjoining panels to secure the panels to each other.

4. The puzzle box device of claim 3 wherein the top lid has at least one depressible panel mounted on a spring and sliding panels with selected sliding panels having notches in the bottom into which the locking pins of the sliding panels on the sides of the puzzle box can be inserted.

5. The puzzle box device of claim 4 wherein depressing the spring-mounted panels and moving the sliding panels in a desired predetermined sequence on the top lid enables it to be unlocked and removed from the puzzle box.

* * * * *